United States Patent [19]

Stanfield, Jr.

[11] Patent Number: 4,509,290

[45] Date of Patent: Apr. 9, 1985

[54] SHUTTER CONSTRUCTION

[76] Inventor: Alvin M. Stanfield, Jr., 73591 El Hasson Cir., Palm Desert, Calif. 91206

[21] Appl. No.: 476,493

[22] Filed: Mar. 18, 1983

[51] Int. Cl.[3] ..... E06B 7/08

[52] U.S. Cl. ..... 49/92; 384/296

[58] Field of Search ..... 49/92, 86, 74, 188, 49/190; 384/295–297, 300

[56] References Cited

U.S. PATENT DOCUMENTS

| | | | |
|---|---|---|---|
| 1,888,522 | 11/1932 | Ward | 49/86 |
| 2,329,868 | 9/1943 | Wood | 49/92 |
| 2,845,153 | 7/1958 | West | 49/92 X |
| 3,065,035 | 11/1962 | Biesecker | 384/296 |
| 4,268,995 | 5/1981 | Villa | 49/388 X |

*Primary Examiner*—Kenneth Downey

*Attorney, Agent, or Firm*—Fulwider, Patton, Rieber, Lee & Utecht

[57] ABSTRACT

An improved shutter construction is provided with a plurality of louvers supported by relatively low friction two-piece bushing assemblies for pivoting movement with respect to a shutter frame in response to operation of a louver tilt rod. The bushing assemblies permit movement of the louvers together substantially without binding between an open position to admit light and air and a closed position wherein ribs and grooves formed on the louvers interlock with one another such that the louvers substantially block passage of light and air.

23 Claims, 4 Drawing Figures

SHUTTER CONSTRUCTION

BACKGROUND OF THE INVENTION

This invention relates generally to improvements in the construction of shutters for windows, doors, and the like. More particularly, this invention relates to an improved shutter construction having movable louvers pivotally supported by relatively low friction bushing assemblies and wherein the louvers are shaped to interlock in a closed position to substantially block passage of light and air through the shutter.

In general, shutters for use in selectively blocking or admitting light and air through windows, doors, and the like are well known. Such shutters typically comprise a generally rectangular open frame which supports a plurality of generally parallel louvers mounted for pivoting movement together to an open position and a closed position in response to operation of a tilt rod. More particularly, the louvers are carried by the frame for pivoting movement to the open position with the louvers oriented generally perpendicular to the plane of the frame thereby defining open passages between the louvers for admission of light and air. The louvers can be pivoted together for movement to the closed position oriented generally within the plane of the frame with adjacent louver margins slightly overlapping one another to substantially block passage of light and air through the shutter frame.

In recent years, it has become highly desirable to provide insulated coverings for windows or the like wherein such coverings are designed for substantially complete blockage of light and or air for energy savings purposes while also providing a suitably decorative appearance. More particularly, in a cold temperature climate, it is highly desirable to block cold air currents in the vicinity of a window thereby permitting a substantial reduction in the energy required to maintain the room at a comfortable temperature. Similarly, in a warm climate particularly such as desert areas, it is highly desirable to prevent solar radiation and heated air currents which may pass through or be present in the vicinity of a window from entering a temperature controlled cooled space. Such blockage of radiation and air currents thereby results in a substantial reduction in the required energy usage for maintaining the room at a comfortable temperature.

In general, however, shutters have not provided the desired degree of light and air current blockage for use as an energy savings device. As a result, shutters have generally not been used in many applications in favor of conventional thermal draperies and the like which, although requiring considerably more frequent replacement than shutters, have generally provided a more effective heat transfer barrier. The comparatively poorer performance of shutters is attributable largely to the inability of the movable louvers to provide substantially complete blockage of light and air when said louvers are in the closed position.

Accordingly, one important object of the present invention is to provide an improved shutter construction which substantially completely blocks light and air when the louvers are in the closed position whereby the shutter of the present invention provides a highly efficient energy savings device which meets or substantially exceeds the heat transfer barrier capacity of conventional thermal draperies and the like.

In the past, another drawback to the use of shutters has related to the manner in which the louvers are supported for pivoting movement with respect to the shutter frame. More particularly, the shutter louvers have been conventionally mounted to the shutter frame by unitary dowel pins of wood or the like which have been formed integrally with the louvers or have comprised separate pin structures received into aligned preformed holes in the louvers and the shutter frame. Such dowel pin structures, however, have inherently provided a relatively high friction pivot joint which is subject to binding and frequently results in relatively noisy shutter operation. Moreover, the use of a high friction pivot joint places a limitation on the number of louvers which can be operated without difficulty thereby placing a corresponding limitation on the overall size of the shutter.

Alternative pivot joint structures have been proposed wherein the dowel pins are formed from relatively low friction materials such as nylon plastic or the like. Such plastic pins advantageously reduce friction of the pivot joint compared with conventional wooden dowel pins, but pivot friction is not sufficiently reduced to prevent binding or noisy operation, particularly with shutters having a large number of louvers. Accordingly, another important object of the present invention is to provide an improved relatively low friction structure for pivotally mounting and supporting louvers with respect to a shutter frame.

SUMMARY OF THE INVENTION

In accordance with the invention, an improved shutter construction is provided having a plurality of generally parallel blade-shaped and interlocking louvers supported by relatively low friction two-piece bushing assemblies for pivoting movement together with respect to a shutter frame in response to operation of a tilt rod. The plurality of louvers is movable between an open position defining open passages through the frame for admitting light and air and a closely interlocked closed position to substantially block passage of light and air. The improved shutter construction therefore permits substantially bind-free, noise-free louver movement to and from the closed position wherein the shutter provides a heat transfer barrier generally matching or exceeding that of conventional insulated draperies and the like.

In accordance with a preferred form of the invention, the shutter construction comprises a generally rectangular shutter frame defined by a pair of upright styles interconnected at their upper and lower ends by upper and lower rails, respectively. A vertically arranged plurality of generally parallel louvers are mounted between the styles with each louver supported for pivoting movement about a horizontal axis between the styles by a pair of two-piece bushing assemblies respectively positioned at opposite ends of the louver. A tilt rod is appropriately connected to the louvers and is operable in a conventional manner to move these louvers together between an open position defining open passages therebetween through which light and air can pass, and a closed position with the louvers lying nearly within the plane of the frame and slightly overlapping one another to block passage of light and air.

Each louver is shaped to include near its upper and lower margins in the closed position a transversely extending rib bounding one side of a transversely extending groove disposed radially between the rib and the associated pivot axis. The rib and groove at the upper margin of each louver are formed to face in a direction opposite the rib and groove at the lower margin, and further, these ribs and grooves are shaped for relatively close interlocking in the closed position with the ribs and grooves of adjacent louvers. Moreover, the upper rail includes a rib and groove for interlocking with the upper margin of the uppermost louver in the shutter, whereas the lower rail includes similar rib and groove for mating engagement with a the lower margin of the lowermost louver. With this construction, the louvers and rails closely interlock with one another in the closed position to substantially block light and air thereby to provide a high heat transfer barrier capability.

Each two-piece bushing assembly comprises a relatively long support pin formed preferably from a low friction plastic to include a shank defined by a series of fetter rings for snug reception into a hole formed in the end of a louver. The support pin further includes a smooth cylindrical bearing surface received at least partially into the louver hole and extending into a somewhat larger aligned hole formed in the adjacent style. A bushing sleeve also formed preferably from a low friction plastic is rotatably received over the cylindrical support surface of the support pin and is captured axially between an enlarged head on the support pin and the adjacent louver. This bushing sleeve includes a series of fetter rings for reception into the style hole and a relatively short smooth cylindrical Each two-piece bushing assembly comprises a relatively long support pin formed preferably from a low friction plastic to include a shank defined by a series of fetter rings for snug reception into a hole formed in the end of a louver. The support pin further includes a smooth cylindrical bearing surface received at least partially into the louver hole and extending into a somewhat larger aligned hole formed in the adjacent style. A bushing sleeve also formed preferably from a low friction plastic has an axial length less than the pin bearing surface. The sleeve is rotatably received over the pin bearing surface and is captured axially between an enlarged head on the support pin and the adjacent louver. This bushing sleeve includes a series of fetter rings for reception into the style hole and a relatively short smooth cylindrical bearing surface disposed generally at and received partially into the open end of the style hole. The support ring and the bushing sleeve are thus secured respectively against rotation relative to the louver and the style such that all rotational movement is accommodated between the support pin and the bushing sleeve, both of which are formed from low friction materials.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
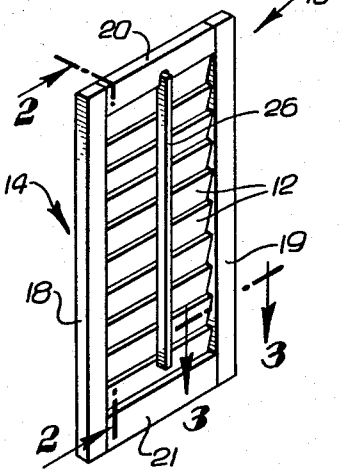
FIG. 1 is a perspective view illustrating a shutter construction embodying the novel features of the present invention.
Figure 2:
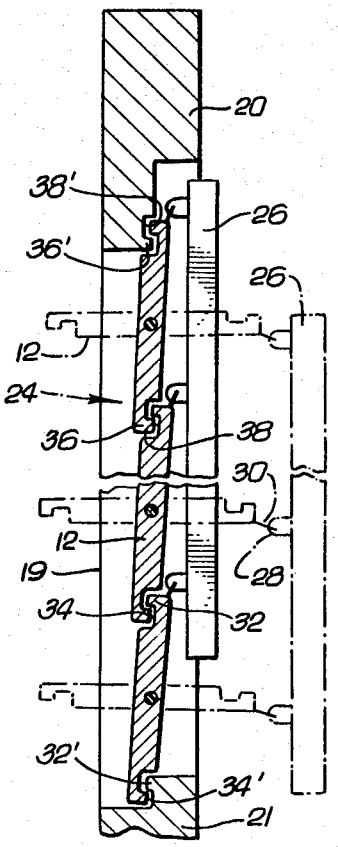
FIG. 2 is an enlarged fragmented vertical section taken generally on the line 2—2 of FIG. 1.

As shown in the exemplary drawings, a shutter referred to generally by the reference numeral 10 includes a plurality of louvers 12 installed within a generally rectangular frame 14 for movement between a closed position generally blocking passage of light and air, as shown in FIG. 1 and in solid lines in FIG. 2, and an open position to permit passage of light and air as depicted by the dotted line positions of the louvers in FIG. 2. In accordance with the present invention, the louvers 12 of the shutter 10 are designed for relatively close interlocking association with each other in the closed position to provide a relatively high heat transfer barrier capability. Moreover, the louvers 12 are supported with respect to the frame 14 by two-piece bushing assemblies 16 (FIGS. 3 and 4) designed to ensure substantially bind-free, noise-free operation.

The shutter construction of the present invention provides a substantial improvement upon conventional shutter designs in that the interlocking louvers in the closed position provide significant improvements in the blockage of light and air. This markedly enhances the ability of the shutter 10 to function as a thermal barrier by blocking light and heat thereby greatly restricting passage of cold air into a heated room, or alternatively, passage of solar radiation and hot air into a cooled room. Shutters constructed in accordance with the invention have been found to provide thermal insulating capability generally equaling or exceeding the insulating capability of conventional thermal draperies and the like thereby permitting installation of shutters in an energy conservation environment in lieu of thermal draperies which require periodic cleaning and replacement.

The shutter construction of this invention further improves upon conventional shutter designs with respect to the two-piece bushing assembly 16 which provides sturdy yet substantially bind-free and noise-free pivoting support for each louver 12. The two-piece bushing assembly 16 is particularly adapted for inexpensive construction from relatively lightweight and inexpensive materials such as nylon plastic or the like and for rapid installation during shutter manufacture. In use, all movement of each louver is accommodated by relative movement between the two bushing pieces which are advantageously formed from low friction materials such that bushing assembly wear, binding, and noise during operation are substantially eliminated.

As shown in FIGS. 1 and 2, the shutter frame 14 of the illustrative shutter 10 comprises a pair of upright styles 18 and 19 formed typically from relatively lightweight wood, although a variety of different materials can be used as desired. The styles 18 and 19 are interconnected in any suitable manner at their upper and lower ends by an upper rail 20 and a lower rail 21, respectively, also typically formed from a relatively lightweight wood or other suitable material. The styles 18 and 19 cooperate with the rails 20 and 22 to define a rectangular central opening 24 across which the louvers 12 extend for selectively opening and closing the opening 24 to control passage of light and air therethrough.

The louvers 12 comprise a plurality of generally flat, blade-like elements having a length chosen to fit relatively closely between the styles 18 and 19. The louvers 12 are arranged in a vertically spaced substantially parallel relation with each louver being pivotally mounted about a central or generally horizontal axis thereof for pivoting movement relative to the styles 18 and 19 by a respective pair of the two-piece bushing assemblies 16, as will be described herein in more detail. The widths of the louvers 12 and their vertical spacings relative to each other are chosen such that the upper and lower margins of the louvers at least slightly overlap one another in the closed position when moved to a nearly vertical orientation lying generally within the plane of the frame 14 to substantially block the frame opening 24 against passage of light and air.

Movement of the louvers 12 to the slightly overlapping condition, referred to hereinafter as the closed position, is controlled by operation of a vertically oriented tilt rod 26 secured to each one of the louvers 12 and disposed at the inboard side of the shutter frame. More particularly, as shown best in FIG. 2, the tilt rod 26 has a vertically spaced plurality of staples 28 secured thereto wherein each staple 28 is interlockingly engaged with a similar staple 30 secured centrally to the upper margin of an associated one of the louvers 12. Accordingly, upward shifting of the tilt rod 26 along its vertical longitudinal axis carries the upper margins of the louvers 12 simultaneously in an upward pivoting direction thereby rotating all of the louvers counterclockwise as viewed in FIG. 2 toward the closed position as depicted by solid lines in FIG. 2. However, reverse or downward shifting movement of the tilt rod 26 pivots the louver upper margins downwardly thereby simultaneously pivoting the louvers 12 toward the open position oriented, as shown by dotted lines in FIG. 2 to define a series of passages between the shutters through which light and air are free to pass.

In accordance with one primary aspect of the invention, each louver 12 includes a transversely extending continuous rib 32 formed generally at its upper margin and facing in an outboard direction away from the tilt rod 26. This transversely extending upper rib 32 bounds one side of a transversely extending groove 34 disposed radially between the ribs 32 and the horizontal pivot axis of the louver. The upper rib 32 and adjacent groove 34 are sized and shaped for complementary and relatively close interlocking engagement with a similar rib 36 and groove 38 formed generally at the lower margin of an adjacent louver 12 to face in an inboard direction toward the tilt rod 26. Accordingly, the plurality of louvers 12 include interlocking pairs of ribs and grooves 32, 34, and 36, 38 thus providing an interlocking direction-changing structure in the overlapping region of adjacent louvers to substantially prevent passage of light and air through this tortuous path.

As shown in FIG. 2, the upper rail 20 includes an inboard-facing rib 36' and groove 38' generally identical with the rib 36 and groove 38 at the lower margin of each louver. Similarly, the lower rail 21 includes an outboard-facing rib 32' and groove 34' generally identical with the rib 32 and groove 34 at the upper margin of each louvers. Accordingly, the uppermost and lowermost louvers 12 of the shutter 10 interlock respectively in the closed position with the upper and lower rails 20 and 21, whereby the entire set of louvers 12 cooperate with each other and with the shutter frame 14 to provide a highly effective barrier to passage of heat and light.

Smooth pivoting operation of each louver 12 is assured by the two-piece bushing assemblies 16, which as described above, are advantageously formed from relatively inexpensive and substantially friction-free components of nylon plastic or the like. One exemplary two-piece bushing assembly is shown by way of example in FIGS. 3 and 4 to include a support pin 42 adapted for secure anchoring into the adjacent end of a louver 12 and for rotatably receiving a bushing sleeve 44 adapted for secure anchoring into the adjacent style 18 or 19, with the style 19 being illustrated in the drawings by way of example. Accordingly, the pin 42 moves with the louver 12 upon louver movement between open and closed positions, whereas the sleeve 44 is secured with respect to the style such that all relative pivoting motion between the louver 12 and style is accommodated by relatively low friction rotational movement of the pin 42 within the sleeve 44.

Figure 3:
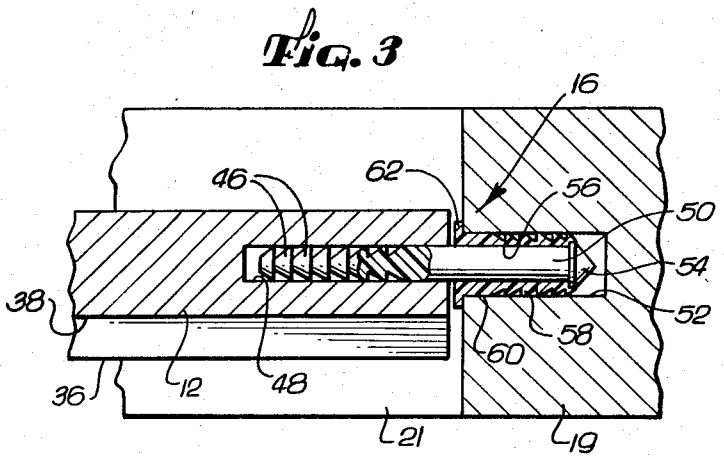
FIG. 3 is an enlarged fragmented horizontal section taken generally on the line 3—3 of FIG. 1, with portions broken away to illustrate construction details of a two-piece bushing assembly embodying the novel features of the invention.
Figure 4:
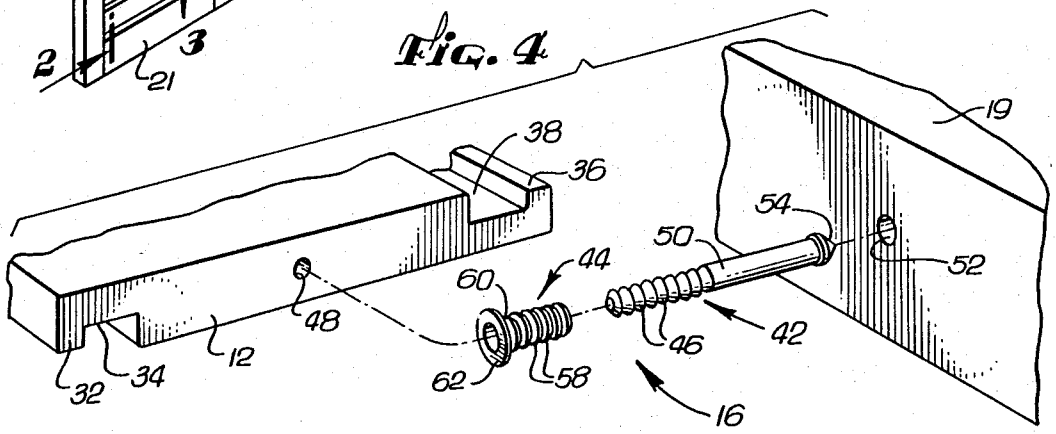
FIG. 4 is an enlarged fragmented exploded perspective view illustrating assembly of the two-piece bushing assembly into the shutter construction of this invention.

The support pin 42 comprises an elongated shank having a series of fetter rings 46 formed at one end thereof for compressive friction fit reception into a matingly shaped hole 48 formed in the end of the louver 12, as shown in FIGS. 3 and 4. The shank further includes a smooth cylindrical bearing surface 50 having a length for at least partial reception into the louver hole 48 and further to extend a substantial distance into a somewhat larger hole 52 formed in the adjacent style. The end of the support pin 42 opposite the fetter rings 46 terminates in a flared head 54 which is advantageously tapered axially with a conical configuration for facilitated initial reception into the adjacent style hole 52.

The bushing sleeve 44 comprises a cylindrical component having an axial length less than the length of the support pin bearing surface 50. This sleeve 44 has a smooth bored inner diameter surface 56 sized and shaped for relatively close sliding reception over and rotatable movement about the cylindrical bearing surface 50 of the support pin 42. A substantial portion of the bushing sleeve outer diameter surface is defined by a series of fetter rings 58 sized and shaped for compressive friction fit reception into the hole 52 in the adjacent style. Importantly, however, a portion of the sleeve outer diameter is defined by a smooth cylindrical bearing surface 60 which blends into a relatively thin flared head 62 at the end of the sleeve 44 opposite the fetter rings 58.

The two-piece bushing assembly 16 is installed by sliding the bushing sleeve 44 over the fetter rings 46 of the support pin 42 to a position carried about the support pin bearing surface 50. The orientation of the bushing sleeve 44 on the support pin 42 is chosen such that the sleeve fetter rings 58 are presented for reception into a style hole 52 whereas the pin fetter rings 46 are presented in an opposite direction for reception into a louver hole 48.

The support pin 42 is then pressed into the louver hole 48 a sufficient distance to bring the head 62 of the bushing sleeve 44 into close proximity with the end of the louver 12. Importantly, the pin bearing surface 50 is received at least partially into the louver hole 48 to provide an uninterrupted and relatively large diameter surface not highly susceptible to breakage from shear forces during shutter operation.

The fetter rings 58 of the bushing sleeve 44 are then pressed into the associated style hole 52 thereby fastening the bushing assembly 16 with respect to the louver 12 and the style. Importantly, the bushing sleeve 44 is thus trapped between the louver 12 and the head 54 of the support pin 42 to prevent the bushing assembly from coming apart thereby facilitating installation of additional bushing assemblies with respect to the opposite ends of the louvers and the other style. Moreover, the cylindrical bearing surface of the bushing sleeve 44 is positioned at the open end of the style hole 52 thereby providing a relatively large diameter surface not highly susceptible to breakage from shear forces during shutter operation.

The shutter construction of this invention thus provides a relatively simple yet highly effective shutter design for substantially completely blocking passage of light and air and to provide a thermal insulating characteristic. Moreover, the shutter provides an improved two-piece bushing assembly designed for relatively friction-free and noise-free operation.

Various modifications and improvements to the invention described herein are believed to be apparent to one of ordinary skill in the art. Accordingly, no limitation on the invention is intended except by way of the appended claims.

What is claimed is:

1. A shutter, comprising:

a shutter frame having a central opening formed therein;

a plurality of louvers; and a pair of bushing assemblies disposed respectively at opposite ends of each of said louvers for pivotally mounting each of said louvers with respect to said frame to extend across said opening generally in parallel with each other, said louvers being pivotally movable between an open position oriented generally perpendicular to the plane of said frame to permit passage of light and air through the frame opening, and a closed position oriented generally within the plane of said frame and at least slightly overlapping one another to block passage of light and air through the frame opening;

said louvers including generally complementary-shaped ribs and grooves for interlocking engagement with each other in said closed position;

each of said bushing assemblies comprising a support pin having an elongated shank including a series of first fetter rings for compression fit reception into a hole formed in the associated end of said louver and a cylindrical bearing surface having a length for at least partial reception into the louver hole and to project therefrom, said pin further having a flared head at the end of said pin opposite said first fetter rings, and a cylindrical bushing sleeve slidably receivable over and rotatable about said support pin, said sleeve having a smooth-surface inner diameter and an axial length less than the axial length of said support pin bearing surface, said sleeve further having an outer diameter surface defined by a series of second fetter rings for compression fit reception into a hole formed in said frame and a sleeve cylindrical bearing surface for at least partial reception into the frame hole.

2. The shutter of claim 1 wherein each of said louvers has an upper margin and a lower margin for overlapping engagement with respect to each other when said louvers are in said closed position said upper margin having one of said ribs bounding one side of one of said grooves and presented in a first direction generally perpendicular to the plane of said frame when said louvers are in said closed position and said lower margin having another one of said ribs bounding one side of another one of said grooves and presented in a second direction generally opposite said first direction.

3. The shutter of claim 2 wherein said shutter comprises a pair of upright styles interconnected at upper and lower ends respectively by a pair of rails, said louvers being mounted between said styles, and wherein said upper and lower rails each include rib means and groove means for complementary interlocking engagement with the ones of said louvers adjacent said upper and lower rails.

4. The shutter of claim 1 including a tilt rod coupled to each of said louvers and operable for moving said louvers together between said open position and said closed position.

5. The shutter of claim 1 wherein said support pin and said bushing sleeve are formed from a relatively low friction material.

6. The shutter of claim 5 wherein said low friction material is nylon plastic.

7. The shutter of claim 1 wherein said flared head of said support pin has a generally conical configuration tapering radially inwardly in a direction axially away from said pin bearing surface.

8. The shutter of claim 1 wherein said bushing sleeve has a relatively thin, radially flared head formed at its end opposite said second fetter rings.

9. A shutter, comprising:

a shutter frame including a pair of upright styles interconnected at upper and lower ends respectively by upper and lower rails, said styles and rails cooperating to define a central opening for passage of light and air;

a plurality of blade-shaped louvers; and a pair of bushing assemblies disposed respectively at opposite ends of each of said louvers for pivotally mounting each of said louvers with respect to said styles to extend between said frame and pivotally mounted with respect thereto for movement between an open position oriented generally perpendicular to the plane of said frame and a closed position oriented generally within the plane of said frame, said louvers having slightly overlapping upper and lower margins when in said closed position;

each of said louvers having a transversely extending rib and transversely extending groove formed at each of its upper and lower margins for complementary interlocking engagement of said louver upper and lower margins when said louvers are in said closed position;

said upper and lower rails including rib means and groove means for complementary interlocking engagement with the upper and lower margins, respectively, of the one of said louvers adjacent said rails;

each of said bushing assemblies comprising a support pin having an elongated shank including a series of first fetter rings for compression fit reception into a hole formed in the associated end of said louver and a cylindrical bearing surface having a length for at least partial reception into the louver hole and to project therefrom, said pin further having a flared head at the end of said pin opposite said first fetter rings, and a cylindrical bushing sleeve slidably receivable over and rotatable about said support pin, said sleeve having a smooth-surface inner diameter and an axial length less than the axial length of said support pin bearing surface, said sleeve further having an outer diameter surface defined by a series of second fetter rings for compression fit reception into a hole formed in the adjacent one of said styles and a sleeve cylindrical bearing surface for at least partial reception into the style hole.

10. The shutter of claim 9 wherein said support pin and said bushing sleeve are formed from a relatively low friction material.

11. The shutter of claim 10 wherein said low friction material is nylon plastic.

12. The shutter of claim 9 wherein said flared head of said support pin has a generally conical configuration tapering radially inwardly in a direction axially away from said pin bearing surface.

13. The shutter of claim 9 wherein said bushing sleeve has a relatively thin, radially flared head formed at its end opposite said second fetter rings.

14. A shutter, comprising:

a shutter frame including a pair of upright styles interconnected at upper and lower ends respectively by upper and lower rails, said styles and rails cooperating to define a central opening;

a plurality of blade-shaped louvers; and a plurality of two-piece bushing assemblies for pivotally mounting said louvers generally in parallel between said styles for pivoting movement between an open position oriented generally perpendicular to the plane of said frame and a closed position oriented generally within the plane of said frame with upper and lower margins of said louvers at least slightly overlapping one another;

each of said louvers having a pair of said bushing assemblies at the opposite ends thereof, and each of said bushing assemblies including an elongated support pin having a shank for press-fit reception into a hole formed in the associated end of said louver and to include a cylindrical bearing surface projecting from said louver hole, and a flared head at the end of said shank projecting from the louver hole, and a cylindrical bushing sleeve for slidable reception over and rotation about said support pin, said sleeve having an axial length less than the axial length of said pin bearing surface and an outer diameter surface for press-fit reception into a hole formed in one of said styles, said sleeve further including a cylindrical bearing surface sized to project at least partially from the style hole, said support pin and said bushing sleeve being formed from a relatively low friction material.

15. The shutter of claim 14 wherein each of said louvers has a transversely extending rib and transversely extending groove formed at each of its upper and lower margins for complementary interlocking engagement with each other when said louvers are in said closed position, said upper and lower rails including rib means and groove means for complementary interlocking engagement with the upper and lower margins, respectively, of the ones of said louvers adjacent said rails.

16. The shutter of claim 14 wherein said low friction material is nylon plastic.

17. The shutter of claim 14 wherein said flared head of said support pin has a generally conical configuration tapering radially inwardly in a direction axially away from said pin bearing surface.

18. The shutter of claim 14 wherein said outer diameter surface of said bushing sleeve is defined by a series of second fetter rings for compression fit reception into a hole formed in the adjacent one of said styles and a sleeve cylindrical bearing surface for at least partial reception into the style hole, said bushing sleeve further having a relatively thin, radially flared head formed at its end opposite said second fetter rings.

19. A shutter comprising:

a shutter frame including a pair of upright styles interconnected at upper and lower ends respectively by upper and lower rails, said styles and rails cooperating to define a central opening;

a plurality of blade-shaped louvers; and a plurality of two-piece bushing assemblies for pivotally mounting said louvers generally in parallel between said styles for pivoting movement between an open position oriented generally perpendicular to the plane of said frame and a closed position oriented generally within the plane of said frame with upper and lower margins of said louvers at least slightly overlapping one another;

each of said louvers having a pair of said bushing assemblies at the opposite ends thereof, and each of said bushing assemblies including, an elongated support pin having a shank for press-fit reception into a hole formed in the associated end of said louver and to include a cylindrical bearing surface projecting from said louver hole, and a flared head at the end of said shank projecting from the louver hole, and a cylindrical bushing sleeve for slidable reception over and rotation about said support pin, said sleeve having an axial length less than the axial length of said pin bearing surface and an outer diameter surface for press-fit reception into a hole formed in one of said styles, said sleeve further including a cylindrical bearing surface sized to project at least partially from the style hole, said support pin and said bushing sleeve being formed from a relatively low friction material;

each of said louvers having a transversely extending rib and transversely extending groove formed at each of its upper and lower margins for complementary interlocking engagement with each other when said louvers are in said closed position;

said upper and lower rails including rib means and groove means for complementary interlocking engagement with the upper and lower margins, respectively, of the ones of said louvers adjacent said rails.

20. A two-piece bushing assembly for rotatably supporting a louver with respect to a frame, comprising:

an elongated support pin having a shank including a series of first fetter rings at one end, a smooth cylindrical bearing surface portion, and a flared head at the shank end opposite said first fetter rings, said first fetter rings being receivable tightly into a hole formed in a louver to position said pin bearing surface portion at least slightly within the louver hole and projecting therefrom; and a bushing sleeve having a generally smooth inner diameter sized to fit slidably over and rotate about said pin bearing surface portion, said sleeve having an axial length less than the axial length of said pin bearing surface portion and an outer diameter surface defined by a series of second fetter rings for relatively tight reception into a hole formed in the style and a smooth bearing surface portion sized for partial reception into the open end of the style hole; said support pin and said bushing sleeve being formed from a relatively low friction material.

21. The bushing assembly of claim 21 wherein said low friction material is nylon plastic.

22. The bushing assembly of claim 21 wherein said flared head of said support pin has a generally conical configuration tapering radially inwardly in a direction axially away from said pin bearing surface portion.

23. The bushing assembly of claim 21 wherein said bushing sleeve has a relatively thin, radially flared head formed at its end opposite said second fetter rings.

* * * * *

UNITED STATES PATENT AND TRADEMARK OFFICE

CERTIFICATE OF CORRECTION

PATENT NO. : 4,509,290

DATED : April 9, 1985

INVENTOR(S) : Alvin M. Stanfield, Jr.

It is certified that error appears in the above-identified patent and that said Letters Patent is hereby corrected as shown below:

Column 3, line 10, delete "a".

Column 3, delete the repeated paragraph beginning on line 16 with the word "Each" and ending on line 30 with the word "cylindrical".

Column 4, line 68, delete "22" and insert therefor --21--.

Column 5, line 66, delete "louvers" and insert therefor --louver--.

Claim 21, line 1, change "21" to --20--.

Claim 22, line 1, change "21" to --20--.

Claim 23, line 1, change "21" to --20--.

Signed and Sealed this

*Seventeenth* Day of *September 1985*

[SEAL]

*Attest:*

*Attesting Officer*

DONALD J. QUIGG

*Commissioner of Patents and Trademarks—Designate*